United States Patent [19]

Kovich

[11] 3,993,290

[45] Nov. 23, 1976

[54] MANUALLY OPERATED AGITATOR FOR THIXOTROPIC SUSPENSIONS

[76] Inventor: Louis Kovich, 658 30th Ave., San Francisco, Calif. 94121

[22] Filed: Oct. 16, 1975

[21] Appl. No.: 622,967

[52] U.S. Cl. ..... 259/29; 259/72; 259/74; 259/76

[51] Int. Cl.[2] ..... B01F 9/00; B01F 11/00; B01F 15/02; B01F 13/00

[58] Field of Search ..... 259/183, 116–118, 259/123, 91–92, 81, 72–74, 29, 76; 222/322

[56] References Cited

UNITED STATES PATENTS

| | | | |
|---|---|---|---|
| 647,769 | 3/1900 | Strawbridge | 259/99 |
| 2,776,120 | 1/1957 | Terrett | 259/72 |
| 3,136,532 | 6/1964 | Rudnick | 259/72 |

*Primary Examiner*—Harvey C. Hornsby
*Assistant Examiner*—Robert Pous
*Attorney, Agent, or Firm*—Robert Charles Hill

[57] ABSTRACT

A manually operated agitator for installation in a container of a thixotropic suspension such as catsup or the like. An enlargement for agitating the suspension by movement therethrough and means for securing the enlargement interior of the container to afford movement in two directions. The securing means is fixed to the interior wall of the container remote from the neck opening of the container and secures the enlargement for movement in a direction generally axially of the container and in a direction generally radially of the point of securement.

6 Claims, 7 Drawing Figures

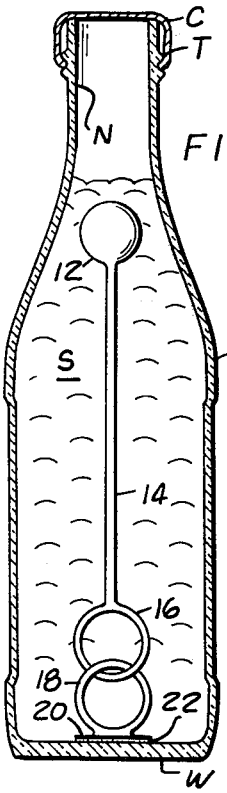
FIG. 1.
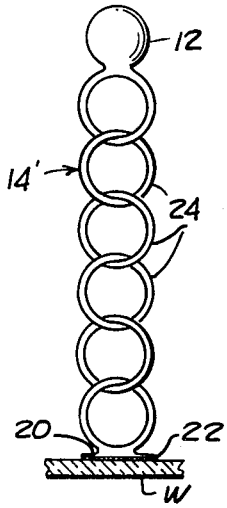
FIG. 2.
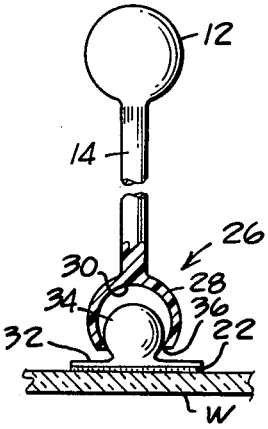
FIG. 3.
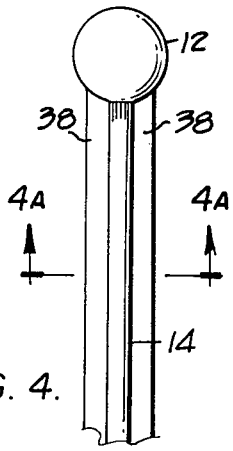
FIG. 4.
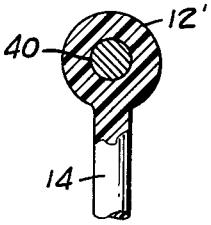
FIG. 5.
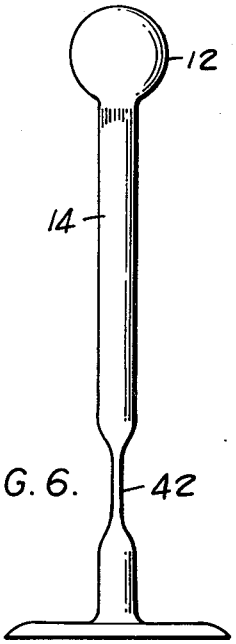
FIG. 6.
FIG. 4A
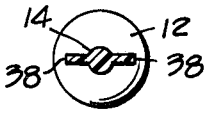

MANUALLY OPERATED AGITATOR FOR THIXOTROPIC SUSPENSIONS

BACKGROUND OF THE INVENTION

1. Field of the Invention

This invention relates to a manually operated agitator for thixotropic suspensions so as to liquify the suspension to facilitate dispensing the same, and more particularly to an agitator that is activated by manually shaking the container in which the suspension resides.

2. Description of the Prior Art

As far as is known the only technique available heretofore for agitating thixotropic suspensions prior to dispensing the same from a container is the provision of a long stirring rod which is introduced through a typically narrow neck opening of such containers. Such technique, although partially successful in expediting dispensing of the thixotropic suspension from the container, is wasteful both of material and time, and results in spillage of the material. This is particularly disadvantageous in the case of diners trying to dispense catsup or mustard or the like from a bottle.

SUMMARY OF THE INVENTION

According to the present invention there is secured to an interior wall of a container one element of a loose joint, i.e., a joint that affords both pivotal movement and axial movement. To the other element of the joint is secured an elongate member at the distal end of which is an enlargement that moves through the suspension and partially and temporarily liquifies the same preparatory to dispensing the suspension from the container. Prior to attempting to dispense the suspension from the container, the user vigorously agitates a container that is supplied with the apparatus of the invention, whereupon the enlargement moves through the suspension in an axial direction, i.e., toward and away from the container opening and in a pivotal or radial direction with respect to the element of the loose joint that is secured to the wall of the container. After a short period of such vigorous shaking, the container is opened and the material can be dispensed since it is partially liquified by the movement of the enlargement through the suspension.

Thixotropic suspensions are characterized by exhibiting a gel-like consistency after residing in a quiescent state for a short period. When in such gel-like state, such suspensions are difficult to dispense, particularly from containers with narrow neck openings such as catsup bottles. Thixotropic suspensions can be partially and temporarily liquified by agitation, and the present invention provides an inexpensive, efficient agitator for effecting agitation of the suspension preparatory to dispensing it from a container.

The principal object of the present invention is to provide a manually operated agitator that facilitates dispensing thixotropic suspensions from containers with relatively narrow neck openings.

Another object of the invention is to provide such agitator that can be installed within existing containers without modification thereto. A feature and advantage of an agitator confined to the interior of a container is that agitation takes place while the container is fully closed, thereby eliminating the waste and inconvenience of spillage while agitating the material.

A further object is to maintain a sterile atmosphere within the container by eliminating the need of stirring the thixotropic suspension with possible adulterated objects such as a knife, straw, etc.

The foregoing, together with other objects, features and advantages, will be more apparent after referring to the following specification and the accompanying drawing.

BRIEF DESCRIPTION OF THE DRAWING

FIG. 1 is an elevation view in cross-section of a typical catsup bottle supplied with one form of agitator constructed according to the present invention.

FIG. 2 is a fragmentary view showing an alternate form of the elongate enlargement supporting member employed in the invention.

FIG. 3 is a fragmentary view of an alternate form of loose joint for securing the elongate member to the wall of the container.

FIG. 4 is a fragmentary view showing an alternate form of elongate member employed in the invention.

FIG. 4A is a cross-sectional view taken along line 4A—4A of FIG. 4.

FIG. 5 is a fragmentary view of an alternate form of enlargement with portions broken away to reveal internal details.

FIG. 6 is a fragmentary view showing another alternate form of elongate enlargement supporting member employed in the invention.

DESCRIPTION OF THE PREFERRED EMBODIMENT

Referring more particularly to the drawing, reference character B indicates a container such as a catsup bottle of well-known configuration and shape. Such container typically has a relatively narrow neck opening and a wall portion W spaced remote from the opening. Surrounding the neck opening is a threaded neck portion T with which is engaged a complementally threaded cap C for sealing or closing the container.

According to the present invention there is an enlargement 12 which is supported for movement through the suspension S within container B in response to agitation of the container. Enlargement 12, as shown in the drawings, is a sphere, and in FIG. 1 is fixed to the distal end of a rigid elongate rod 14. At the opposite end of rod 14 is a ring 16 having a relatively large opening. In one form of the invention enlargement 12, elongate rod 14 and ring 16 are integrally molded from a suitable synthetic plastic material. Obviously it is essential that the material be selected so as to be inert with respect to the thixotropic suspension S.

Linked through the opening formed by loop 16 is a second loop 18 which defines an opening that has a large diameter as compared with the thickness of loop 16, so that the former loop can move both pivotally and axially relative to the second loop 18. Second loop 18 has an integral base 20 which is joined by a suitable adhesive 22 to wall portion W of container B. In selecting adhesive 22 for securing base 20 to the wall portion, it is important to employ an adhesive that will not be adversely affected by thixotropic suspension S and will not adversely affect the suspension.

In operation of the embodiment shown in FIG. 1 with cap C in place, container B is vigorously agitated either in the upright position shown in the figure or an inverted or other position. Such agitation causes enlargement 12 to move through suspension S, which movement at least temporarily liquifies the suspension to facilitate dispensing the same through narrow neck opening N. The movement can take place toward and away from the neck opening because the diameters of loops 16 and 18 are relatively small compared with the central openings defined by the loops. Pivotal or radial movement of enlargement 12 can take place because of the loose joint provided by the loose interengagement between loop 16 and 18. After a brief period of agitation, the container B is restored to its upright position, the cap is removed, and the material can be dispensed in a convenient and controlled manner.

It will be noted in FIG. 1 that elongate member 14 has a length such that enlargement 12 is spaced from neck opening N so as to avoid blocking the neck opening and to avoid restricting the radial or pivotal movement of enlargement 12 through the suspension.

FIG. 2 discloses a modification wherein an elongate member 14' is in the form of chain constituted by a plurality of inter-linked loops 24. The diameter of the loops is substantially less than the openings defined by the respective loops so that both pivotal and axial movement of enlargement 12 with respect to wall W is afforded. The criteria for selecting the material for loop 24 is the same as that referred to above in connection with the embodiment in FIG. 1.

FIG. 3 depicts still another modification of the present invention. The loose fitting joint formed by loops 16 and 18 in FIG. 1 is replaced in the embodiment of FIG. 3 by a loosely fitting ball and socket joint 26. At the end of elongate rod 14 remote from enlargement 12 is a socket 28 which defines a spherical cavity 30. There is a base 32 secured to container wall portion W by adhesive 22; rigid with the base 32 is a ball 34 which has a diameter substantially less than the diameter of spherical cavity 30. Sphere 28 is truncated to form a circular mouth opening 36 which mouth opening has a diameter less than the diameter of ball 30 so as to retain the two parts of the loose fitting joint engaged with one another.

The operation of the embodiment of the invention of FIG. 3 is substantially identical to that disclosed above in connection with FIG. 1. Because ball 34 has a diameter less than spherical cavity 30, elongate rod 14 and enlargement 12 experience the two degrees of movement in response to vigorous agitation of the container of which wall portion W is a part. Consequently the enlargement moves through the thixotropic suspension and liquifies the same preparatory to dispensing the suspension.

Yet a further modification is shown in FIGS. 4 and 4A. In such modification, there are secured to elongate member 14 one or more longitudinally extending vanes 38. There can be two vanes as shown in the embodiment of FIGS. 4 and 4A, or any other suitable number. The vanes enhance the agitation to which the suspension is subjected as enlargement 12 moves pivotally with respect to wall portion W and has the advantage of subjecting the suspension to agitation even when the level of the same is relatively low in container B. The choice of materials for the embodiment of FIGS. 4 and 4A is subject to the same criteria as described above in connection with FIG. 1.

Another alteration of the invention is shown fragmentarily in FIG. 5. In FIG. 5 an enlargement 12' is shown fixed to the distal end of elongate member 14. Centrally of enlargement 12' is a body 40 of relatively heavy material, such as steel or lead. Notwithstanding the relatively toxicity of such material, it does not interact with the material in suspension S because it is totally circumscribed by the material of which enlargement 12' is formed. The alteration shown in FIG. 5 is particularly suitable for relatively thick suspensions in that greater movement can be imparted to the relatively heavier enlargement. The operation of the invention as modified in accordance with FIG. 5 is identical to that described hereinabove.

Another alteration of the invention is shown in FIG. 6 wherein an enlargement 12 is fixed to the distal end of elongate member 14. Near or at the bottom of member 14 is narrow portion 42 which allows agitational movement of enlargement 12 and elongate member 14 during shaking of the container. In this modification elongate member 14 is of one piece construction.

Thus it will be seen that the present invention provides an extremely simple, low cost device that can be quickly and economically produced and installed in existing containers without any modification to the containers. The utility of the containers and the dispensing of their contents is materially enhanced by the present invention because several quick and vigorous shakes will at least partially and temporarily liquify the thixotropic suspension in the container so as to permit dispensing the same in a convenient and controlled manner. The configuration of the agitator of the invention is such as to occupy a very small portion of the volume within container B, and because the agitator is formed of material that is inert with respect to the suspension, it does not interfere with or adversely affect the normal utility of the container and its contents. Although several embodiments have been shown and described, it will be obvious that other adaptations and modifications can be made without departing from the true spirit and scope of the invention.

It should also be understood that the elongate member 14 may be attached to a side wall of the container as well as the bottom wall thereof. With side wall attachment the length of elongate member 14 is limited by the inside diameter of the container.

What is claimed is:

1. An agitator for facilitating dispensing a thixotropic suspension from a container having small neck aperature and a wall portion disposed remote from said opening and spaced therefrom comprising a rigid enlargement having a diameter less than said opening, an elongate rod member having a first end fixed to said enlargement and a second end remote from said first end, said elongate rod member having a length less than the distance from said wall portion to said neck opening, and means for securing said agitator to said wall portion, said securing means having a ring rigid with the second end of said rod, a loop interlinked with said ring, said ring and loop defining openings substantially larger than the diameter of the members respectively forming the ring and the loop so as to afford axial and pivotal movement to said rod and said enlargement, and means for attaching said loop to said wall portion.

2. An agitator according to claim 1 wherein said enlargement comprises a substantially spherical shaped member.

3. An agitator according to claim 2 wherein said spherical shaped member includes a core of relatively dense material totally encased by a relatively lightweight material, said lightweight material being inert to the thixotropic suspension.

4. An agitator according to claim 1 wherein said enlargement includes at least one vane secured to said elongate member, said vane having a plane surface generally parallel to the axis of elongation of said elongate member.

5. An agitator for facilitating dispensing a thixotropic suspension from a container having small neck aperature and a wall portion disposed remote from said opening and spaced therefrom comprising a rigid enlargement having a diameter less than said opening, an elongate member having a first end fixed to said enlargement and a second end remote from said first end, said elongate member having a length less than the distance from said wall portion to said neck opening, said elongate member having a plurality of closed links mutually interlinked to form a chainlike member, at least some of the links having an opening substantially greater than the diameter of the part that forms the opening to afford axial and pivotal movement, and means for securing said second end to said wall portion.

6. An agitator for facilitating dispensing a thixotropic suspension from a container having small neck aperature and a wall portion disposed remote from said opening and spaced therefrom comprising a rigid enlargement having a diameter less than said opening, an elongate rod member having a first end fixed to said enlargement and a second end remote from said first end, said elongate rod member having a length less than the distance from said wall portion to said neck opening, and means for securing said agitator to said wall portion, said securing means having a loosely fitting ball and socket joint including a socket defining a spherical cavity fixed to said second end, a ball having a diameter less than that of the spherical cavity to afford axial and pivotal movement, and means for attaching said ball to said wall portion.

* * * * *